US011389350B2

(12) United States Patent
DuFresne et al.

(10) Patent No.: US 11,389,350 B2
(45) Date of Patent: Jul. 19, 2022

(54) ADJUSTABLE BACK SUPPORT

(71) Applicant: PERMOBIL, INC., Lebanon, TN (US)

(72) Inventors: Steven DuFresne, Hartland, WI (US); Adam Karpinski, Nashville, TN (US)

(73) Assignee: PERMOBIL, INC., Lebanon, TN (US)

( * ) Notice: Subject to any disclaimer, the term of this patent is extended or adjusted under 35 U.S.C. 154(b) by 0 days.

(21) Appl. No.: 17/037,135

(22) Filed: Sep. 29, 2020

(65) Prior Publication Data

US 2022/0096294 A1 Mar. 31, 2022

(51) Int. Cl.

| | |
|---|---|
| ***A47C 7/40*** | (2006.01) |
| ***A47C 7/46*** | (2006.01) |
| ***A61G 5/10*** | (2006.01) |
| ***A61G 5/12*** | (2006.01) |

(52) U.S. Cl.

CPC ..... *A61G 5/1056* (2013.01); *A47C 7/46* (2013.01); *A61G 5/122* (2016.11)

(58) Field of Classification Search

CPC .. A47C 7/42; A47C 7/425; A47C 7/38; A47C 7/383; A47C 7/185; A47C 7/46; A61G 5/1056; A61G 5/1067; A61G 5/122

USPC .... 297/284.3, 284.9, 452.33, 452.34, 452.36

See application file for complete search history.

(56) References Cited

U.S. PATENT DOCUMENTS

| | | | | |
|---|---|---|---|---|
| 4,322,111 A | | 3/1982 | Barley et al. | |
| 4,797,934 A | * | 1/1989 | Hufnagel | B60N 2/868 297/398 X |
| 5,407,248 A | | 4/1995 | Jay et al. | |
| 5,564,788 A | | 10/1996 | Warhaftig | |
| 5,868,471 A | * | 2/1999 | Graham | B60N 2/885 297/397 X |
| 6,032,975 A | * | 3/2000 | Hanson | A61G 5/00 280/250.1 |
| 6,095,611 A | | 8/2000 | Bar et al. | |
| 6,123,389 A | * | 9/2000 | O'Connor | A47C 7/383 297/397 |
| 6,250,716 B1 | * | 6/2001 | Clough | A47C 7/383 297/408 |
| 6,257,664 B1 | * | 7/2001 | Chew | A61G 5/12 297/284.9 X |

(Continued)

FOREIGN PATENT DOCUMENTS

| | | | | |
|---|---|---|---|---|
| CA | 2901769 A1 | * | 8/2014 | A61G 5/12 |

OTHER PUBLICATIONS

Tarta, "Original Technical Sheet," <https://tartadesign.it/sites/default/files/downloads/technical_sheet_original_eng_int_rev.01-05.08.16.pdf>, rev. 01-05-08.16, May 8, 2016 (10 pages).

*Primary Examiner* — Rodney B White
(74) *Attorney, Agent, or Firm* — Michael Best & Friedrich LLP

(57) ABSTRACT

An adjustable back support for a mobility device includes a first adjustable back support assembly including a first support member and a second support member, and a second adjustable back support assembly. The first support member is moveably connected to the second adjustable back support assembly, the first support member being configured to pivot relative to the second adjustable back support assembly relative to a first axis of rotation, and the second support member is moveably connected to the first support member, the second support member being configured to pivot relative to the first support member relative to a second axis of rotation that is not parallel to the first axis of rotation.

27 Claims, 14 Drawing Sheets

(56) References Cited

U.S. PATENT DOCUMENTS 6,305,749 B1 * 10/2001 O'Connor ..... A47C 7/383 297/397
6,361,118 B1 3/2002 Melgarejo et al.
6,378,947 B1 4/2002 Barber et al.
6,688,693 B2 * 2/2004 Christofferson ..... A61G 5/12 297/284.3 X
6,695,410 B2 2/2004 Hsia
7,080,886 B2 * 7/2006 Bauer ..... B60N 2/838 297/408 X
7,093,903 B2 8/2006 O'Connor et al.
7,237,848 B1 * 7/2007 Story ..... B60N 2/665 297/284.3
7,264,313 B2 * 9/2007 Clough ..... B60N 2/885 297/407
7,303,232 B1 * 12/2007 Chen ..... A47C 7/38 297/408 X
7,364,239 B2 4/2008 Clough
7,472,956 B2 * 1/2009 Makhsous ..... A61G 5/1091 297/284.9 X
7,475,943 B1 1/2009 Huang
7,967,379 B2 * 6/2011 Walters ..... B60N 2/666 297/284.9 X
8,578,560 B1 11/2013 Swinehart et al.
8,911,020 B2 12/2014 Westerink et al.
9,216,121 B2 * 12/2015 Galante ..... A61G 5/122
9,380,878 B1 * 7/2016 Chen ..... A47C 7/38
9,486,079 B2 * 11/2016 Romero ..... A47C 7/46
9,717,637 B2 * 8/2017 Bucher ..... A61G 5/124
9,789,019 B2 10/2017 DuFresne
9,872,568 B2 1/2018 Capra et al.
9,986,840 B2 6/2018 DuFresne
10,034,804 B2 * 7/2018 Jurkiewicz ..... A61G 5/121
10,182,953 B2 * 1/2019 Tsuber ..... A61G 5/122
10,258,820 B2 4/2019 Harlow
10,264,891 B2 4/2019 DuFresne
10,327,554 B2 6/2019 DuFresne
10,369,065 B2 8/2019 DuFresne
10,492,966 B2 12/2019 DuFresne
10,595,635 B2 3/2020 DuFresne
10,595,639 B2 3/2020 DuFresne
10,716,721 B2 7/2020 Culver et al.
10,874,221 B1 * 12/2020 Lin ..... A47C 7/383
10,973,330 B2 * 4/2021 Scarlett ..... A47C 7/40
2004/0007910 A1 * 1/2004 Skelly ..... B64D 11/0647 297/406
2004/0046435 A1 * 3/2004 Bonn ..... A47C 7/38 297/409
2004/0195893 A1 * 10/2004 Clough ..... A47C 7/38 297/391
2004/0217639 A1 * 11/2004 Clough ..... A47C 7/38 297/391
2006/0033375 A1 * 2/2006 Wu ..... A47C 7/38 297/408
2007/0246988 A1 * 10/2007 Hung ..... A47C 1/023 297/353
2008/0067850 A1 3/2008 Stenstrom et al.
2008/0258532 A1 * 10/2008 Cassaday ..... A47C 7/38 297/408
2008/0309139 A1 * 12/2008 Oda ..... A47C 1/036 297/410
2009/0200851 A1 * 8/2009 Link ..... A47C 7/38 297/408 X
2013/0127219 A1 5/2013 Gerwig
2013/0234490 A1 * 9/2013 Millan ..... A47C 7/38 297/391
2013/0307309 A1 * 11/2013 Mo ..... A47C 7/383 297/440.1
2016/0113804 A1 4/2016 Desvaux De Marigny
2017/0087037 A1 * 3/2017 Scarlett ..... A61G 5/121
2017/0224117 A1 * 8/2017 DuFresne ..... A61G 5/121
2018/0014651 A1 1/2018 Patel
2018/0103765 A1 * 4/2018 Chen ..... A47C 7/38
2019/0192901 A1 6/2019 Harlow
2019/0216662 A1 7/2019 Farricielli
2020/0383484 A1 * 12/2020 Chernin ..... A61G 5/1067
2020/0405059 A1 * 12/2020 Chen ..... A47C 7/006
2021/0007491 A1 * 1/2021 Budiman ..... A47C 7/383

* cited by examiner

ADJUSTABLE BACK SUPPORT

FIELD OF THE DISCLOSURE

The present disclosure relates to an adjustable back support for a chair. More specifically, the present disclosure relates to a back support for a wheelchair that includes a plurality of separately adjustable support assemblies, which are configured to selectively adjust one or more flexible deformities in the sagittal plane, while also being configured to accommodate one or more fixed deformities in the sagittal plane, to improve support for a user that is sitting in the wheelchair.

SUMMARY

In one embodiment, an adjustable back support for a mobility device includes a first adjustable back support assembly including a first support member and a second support member, and a second adjustable back support assembly. The first support member is moveably connected to the second adjustable back support assembly, the first support member being configured to pivot relative to the second adjustable back support assembly relative to a first axis of rotation, and the second support member is moveably connected to the first support member, the second support member being configured to pivot relative to the first support member, the second support member being configured to pivot relative to the first support member relative to a second axis of rotation that is not parallel to the first axis of rotation.

In another embodiment, a wheelchair includes an adjustable back support including a first adjustable back support assembly defining a first support member and a second support member, and a second adjustable back support assembly. The first support member is configured to pivot relative to the second adjustable back support assembly along a first axis of rotation. The second support member is configured to pivot relative to the first support member along a second axis of rotation that is not parallel to the first axis of rotation.

In yet another embodiment, a method of conforming an adjustable back support to a user includes adjusting a first lower back support to selectively engage and rotate a pelvis towards a pelvic neutral position, adjusting a second lower back support to selectively engage a lumbar portion of a spine to support a natural lumbar curve, and adjusting a first upper back support to selectively engage a thoracic region of the spine to support a natural thoracic curve.

Other aspects of the invention will become apparent by consideration of the detailed description and accompanying drawings.

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

While the present disclosure illustrates an adjustable back support 100 for use with a wheelchair, it should be appreciated that a wheelchair is provided for purposes of illustration and is not limiting. The adjustable back support 100 can be used not only with a wheelchair, but also in association with any suitable sitting platform, mobility device, or a chair, including, but not limited to, an armchair, rocking chair, car seat, swivel chair, office chair, recliner, director's chair, high chair, sofa, backed stool, or any other suitable device for supporting a person while sitting.

Figure 1:
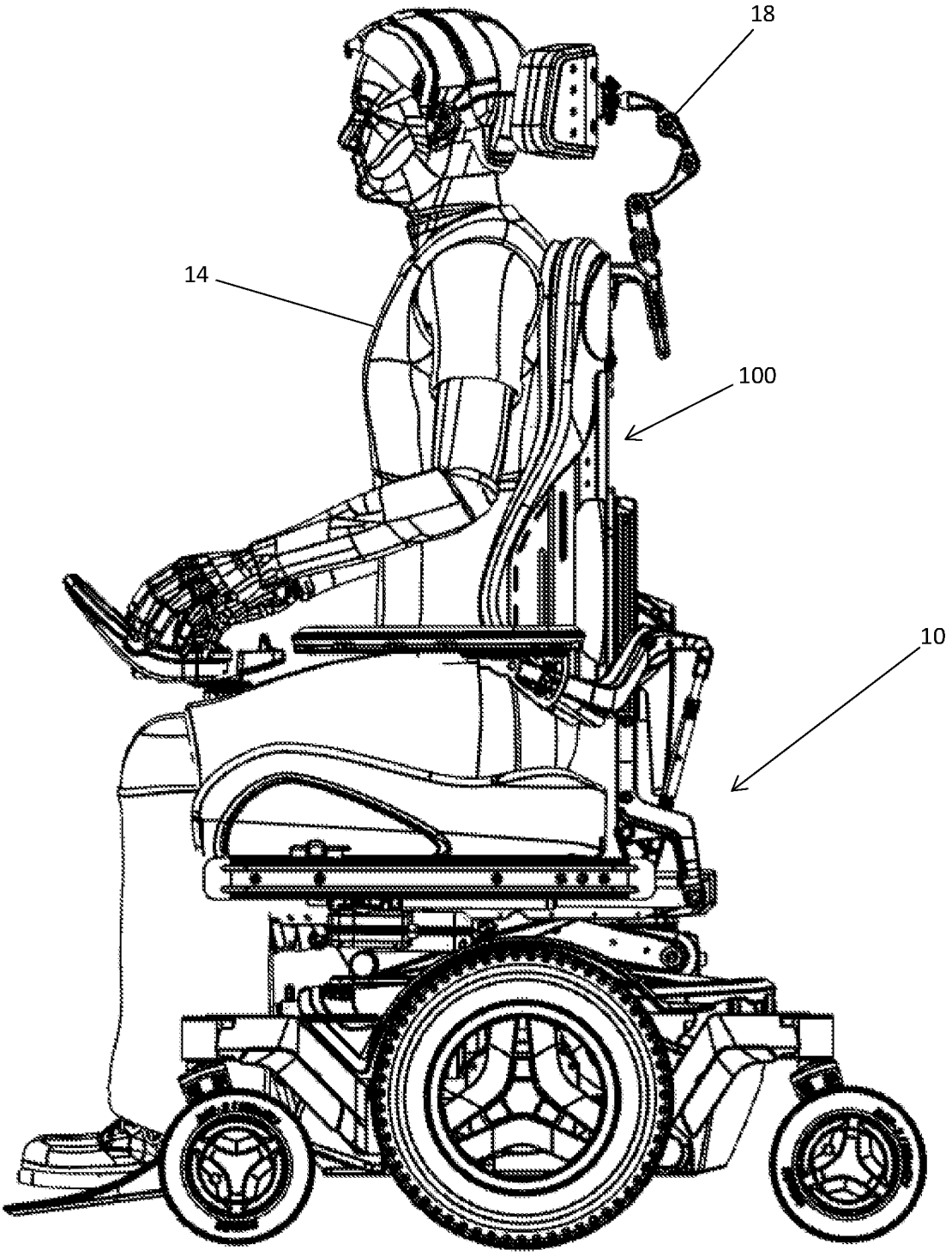
FIG. 1 is a side view of a wheelchair that includes an example of an embodiment of an adjustable back support, illustrating a user positioned in the wheelchair and supported by the back support.
Figure 2:
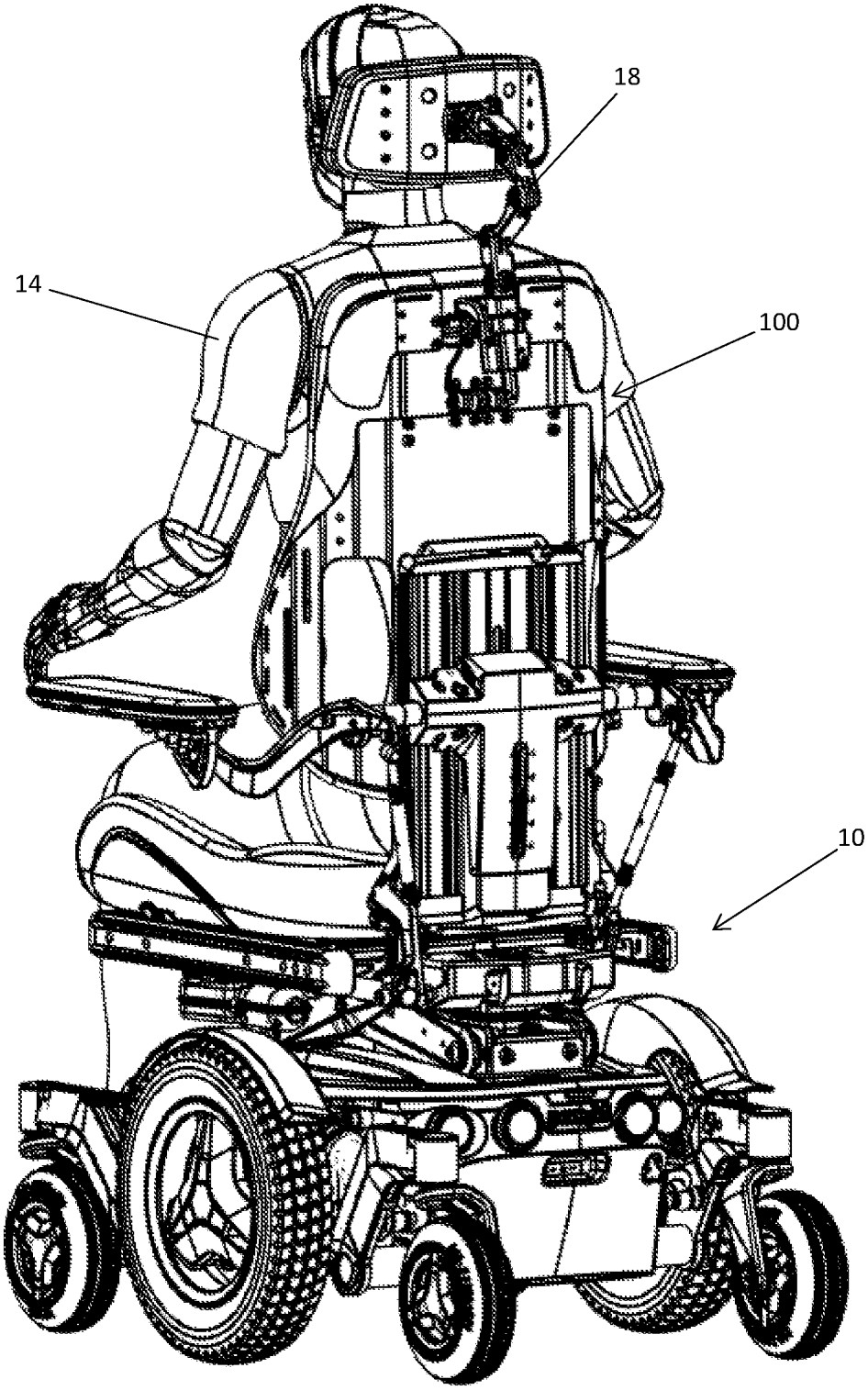
FIG. 2 is a rear perspective view of the wheelchair and adjustable back support shown in FIG. 1.

FIGS. 1 and 2 provide different views of a mobility device 10, shown as a wheelchair 10, that incorporates an example of an embodiment the adjustable back support 100. A user 14 is shown positioned in the wheelchair 10 and is supported by the adjustable back support 100. A head support 18 is coupled to the adjustable back support 100, and is configured to support the head of the user 14. The illustrated wheelchair 10 is a power wheelchair 10, and more specifically an M3 CORPUS power wheelchair sold by Permobil AB, which has a corporate headquarters in Timrå, Sweden. In other embodiments, the power wheelchair 10 can be any suitable power wheelchair. It should also be appreciated that the wheelchair 10 is shown as a power wheelchair 10 for purposes of illustration. The adjustable back support 100 is not limited for use with a powered wheelchair, and can be used with any suitable wheelchair, such as a manual wheelchair. The illustrated head support 18 is a BODILINK head support 18 sold by The Comfort Companies, Inc. a division of Permobil AB, which has a corporate headquarters in Timrå, Sweden. An example of the head support 18 is also disclosed in U.S. Pat. Nos. 10,327,554 and 10,716,721, the contents of each patent is hereby incorporated by reference in its entirety. In other embodiments, any suitable head support associated with a wheelchair or other type of chair can be used.

Figure 3:
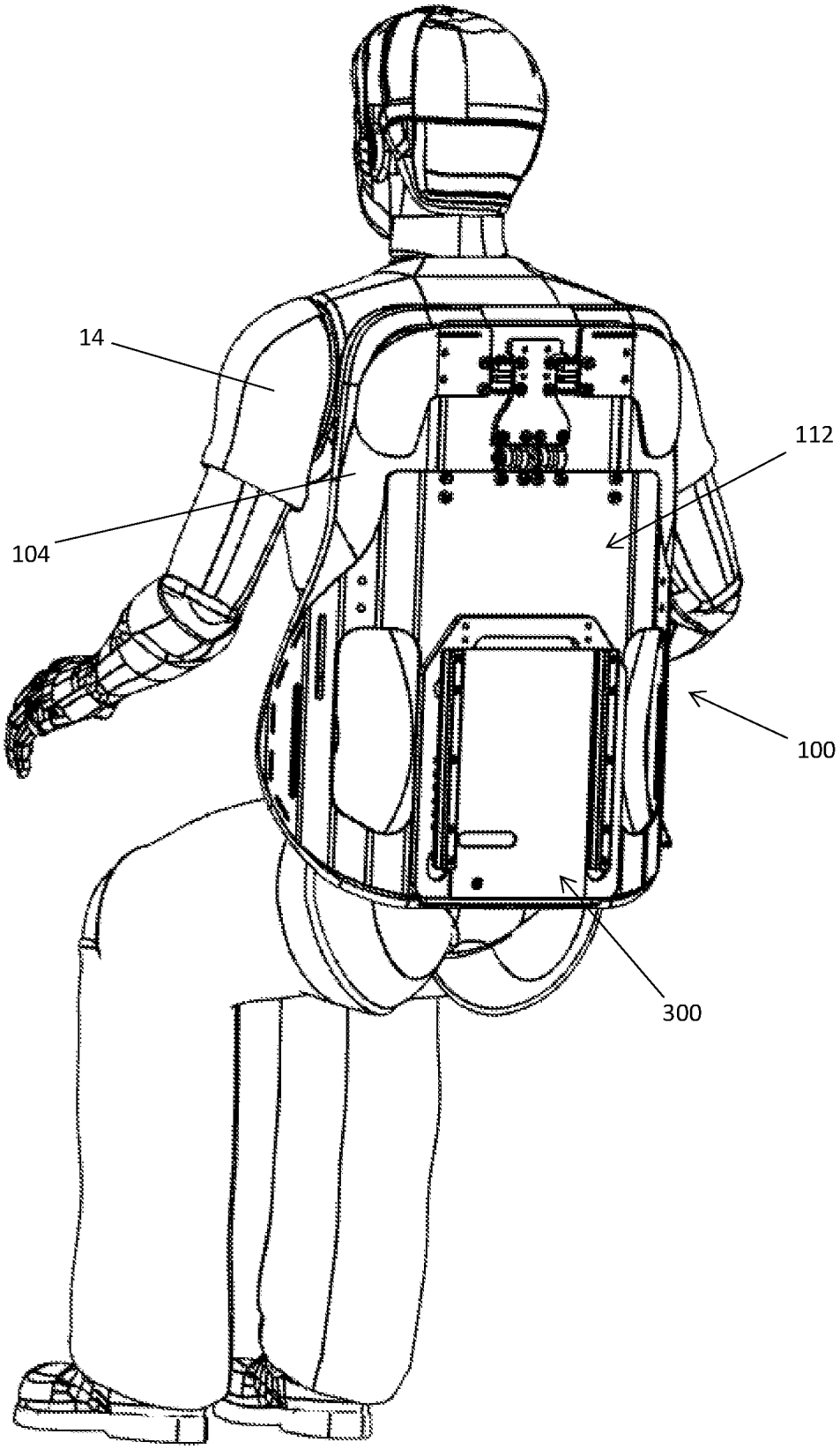
FIG. 3 is a rear perspective view of the adjustable back support shown in FIG. 2, with a head support and the wheelchair removed for clarity.

FIG. 3 illustrates the adjustable back support 100 with the wheelchair 10 and the head support 18 removed for clarity. A pad 104 is provided on a first side 108 (also referred to as a user facing side 108) (shown in FIG. 7) of the adjustable back support 100. The pad 104 can include foam, a plurality of layers of foam, foam-like materials, or any other suitable materials that can provide comfort to the user 14 while reducing a risk of friction based, pressure based, or other types of sores or injury. The pad 104 is configured to be removable from the adjustable back support 100 to facilitate repair, replacement, or cleaning. A mounting assembly 300 is coupled to a second side 112 (also referred to as a back side 112) of the adjustable back support 100. The second side 112 of the adjustable back support 100 is opposite the first side 108. The mounting assembly 300 is configured to facilitate attachment of the adjustable back support 100 to the wheelchair 10. The mounting assembly 300 is discussed in additional detail below.

Figure 4:
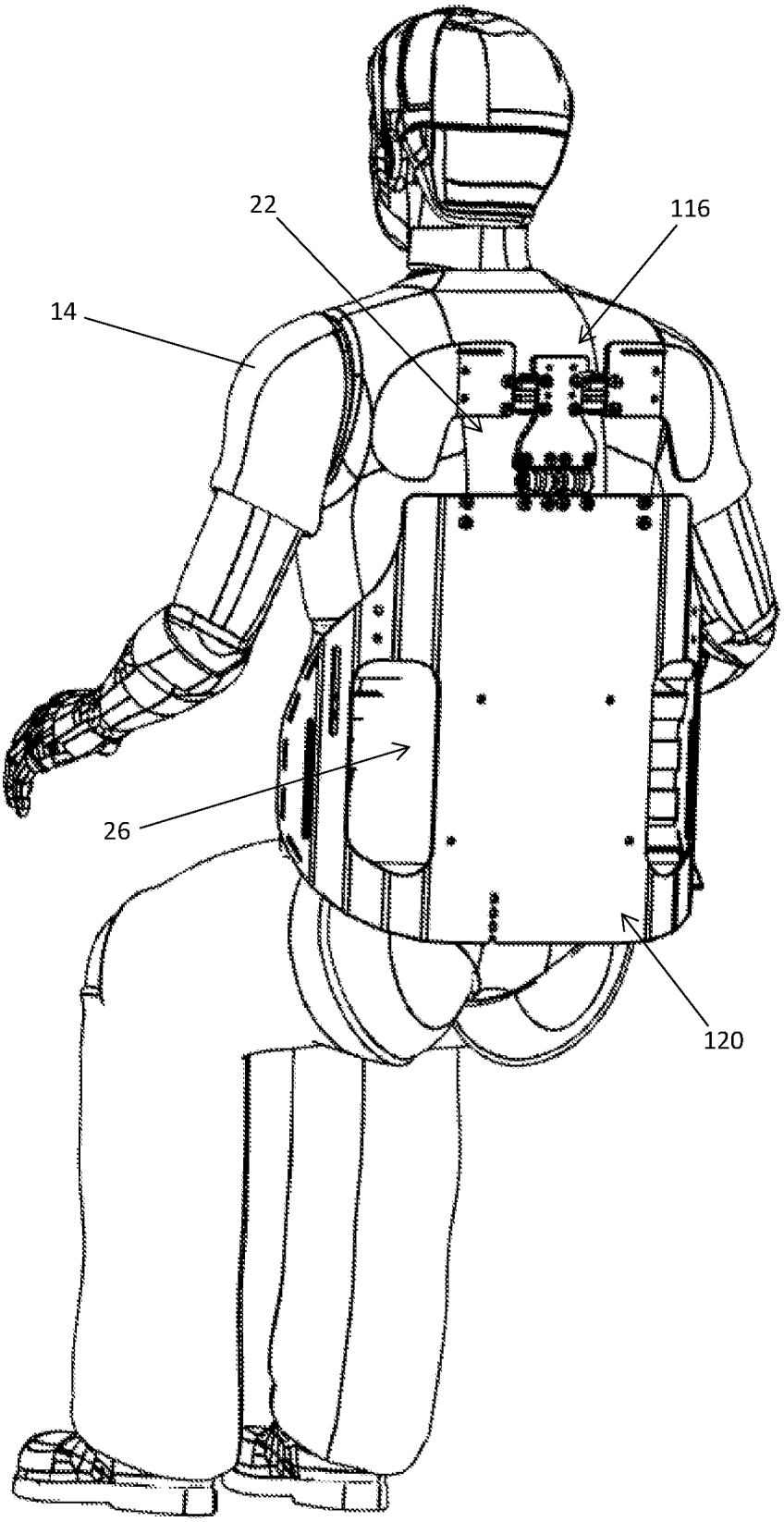
FIG. 4 is a rear perspective view of the adjustable back support shown in FIG. 3, with a pad and a mounting assembly removed for clarity.

FIG. 4 illustrates the adjustable back support 100 with the wheelchair 10, the head support 18, the pad 104, and the mounting assembly 300 removed for clarity. The adjustable back support 100 includes a first adjustable back support assembly 116 coupled to a second adjustable back support assembly 120. The first adjustable back support assembly 116 is separately adjustable relative to the second adjustable back support assembly 120. The first adjustable back support assembly 116 is configured to engage a first portion 22 of the user 14, while the second adjustable back support assembly 120 is configured to engage a second portion 26 of the user 14. The adjustable back support 100 accordingly includes a plurality of separately adjustable back support assemblies 116, 120 that respectively provide support to different portions of the user 14. The first portion 22 of the user 14 is generally in an area defined by the upper thoracic vertebrae of the user 14 (or an area of the thoracic vertebrae closer to the cervical vertebrae than the lumbar vertebrae, or an area in communication with the thoracic vertebrae). The first portion 22 can also be defined relative to a scapula area (or scapular range) of the user 14 (or around the scapular area of the user 14). The scapula area of the user 14 is approximately above the T6 vertebrae of the spine of the user 14, and more specifically in the range of the T1-T6 vertebrae of the spine of the user 14. The second portion 26 of the user 14 is generally in an area defined relative to the lumbar vertebrae (or an area of the lower thoracic vertebrae closer to the lumbar vertebrae than the cervical vertebrae). Accordingly, the first portion 22 of the user 14 is nearer the head of the user 14 than the second portion 26 of the user 14. Stated another way, the second portion 26 of the user 14 is closer to the sacrum (or coccyx) than the first portion 22 of the user 14. To facilitate engagement with the respective first and second portions 22, 26 of the user 14, the first adjustable back support assembly 116 is vertically offset from the second adjustable back support assembly 120 relative to the spine of the user 14. The first portion 22 can also be referred to as a first portion of the back 22, and the second portion 26 can also be referred to as a second portion of the back 26.

Figure 5:
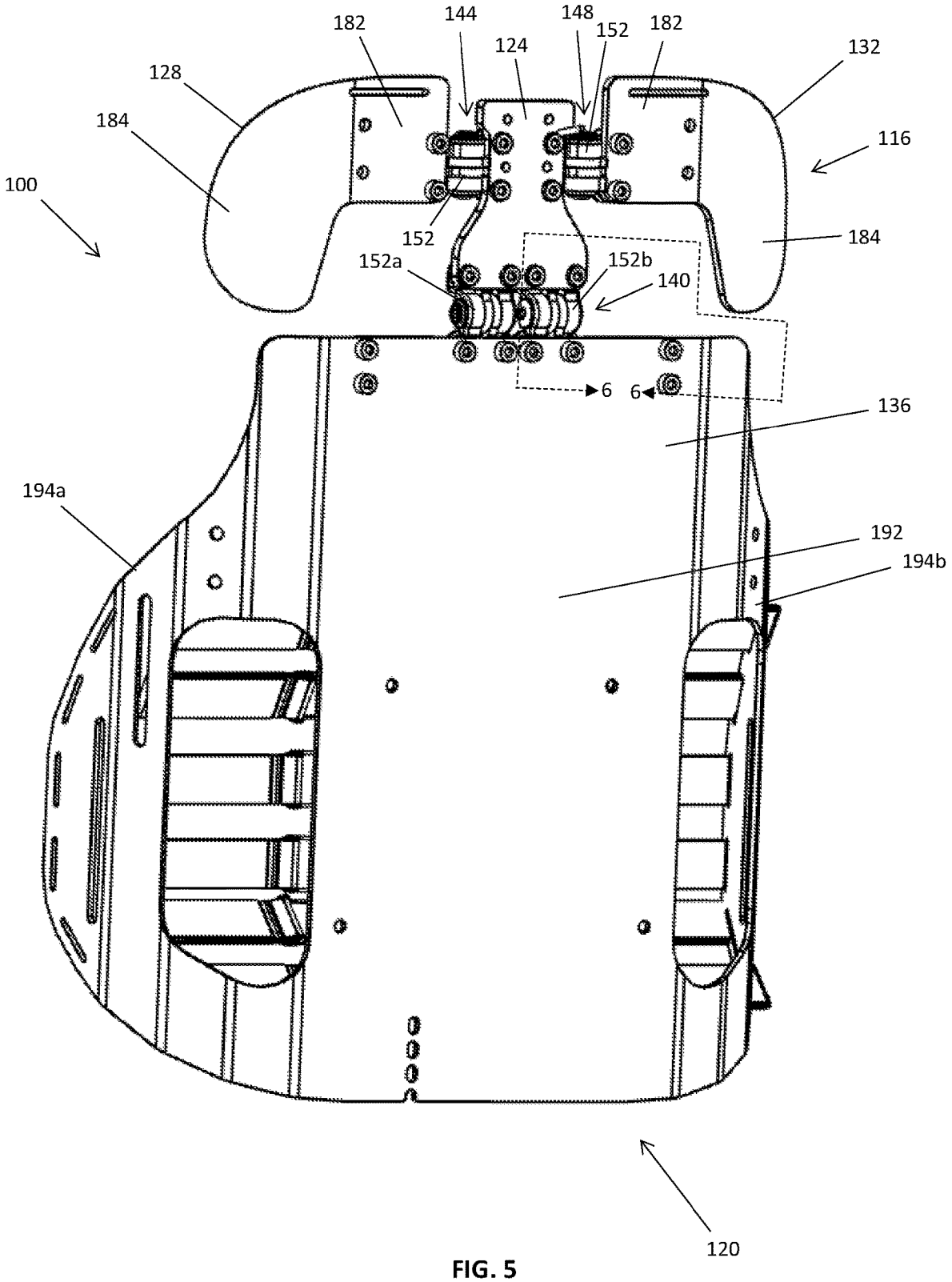
FIG. 5 is a rear perspective view of the adjustable back support shown in FIG. 4, with the user removed.

FIG. 5 illustrates the adjustable back support 100 with the user 14 removed. The first adjustable back support assembly 116 (also referred to as an upper back support assembly 116) includes a first support member 124, a second support member 128, and a third support member 132. The first support member 124 is coupled to the second adjustable back support assembly 120 (also referred to as a lower back support assembly 120). More specifically, the first support member 124 is coupled to a support shell 136 of the second back support assembly 120. The first support member 124 is coupled to the support shell 136 by a first hinge assembly 140. The second support member 128 is coupled to the first support member 124 by a second hinge assembly 144. The third support member 132 is coupled to the first support member 124 by a third hinge assembly 148.

Each hinge assembly 140, 144, 148 is defined by at least one hinge member 152. In the illustrated example of embodiment, the first hinge assembly 140 includes a first hinge member 152*a* and a second hinge member 152*b*. The second hinge assembly 144 includes one hinge member 152, and the third hinge assembly 148 includes one hinge member 152. In other examples of embodiments, the first hinge assembly 140 can include a single hinge member 152, the second hinge assembly 144 can include a plurality of hinge members 152, 152*a*, 152*b*, and/or the third hinge assembly 148 can include a plurality of hinge members 152, 152*a*, 152*b*.

Figure 6:
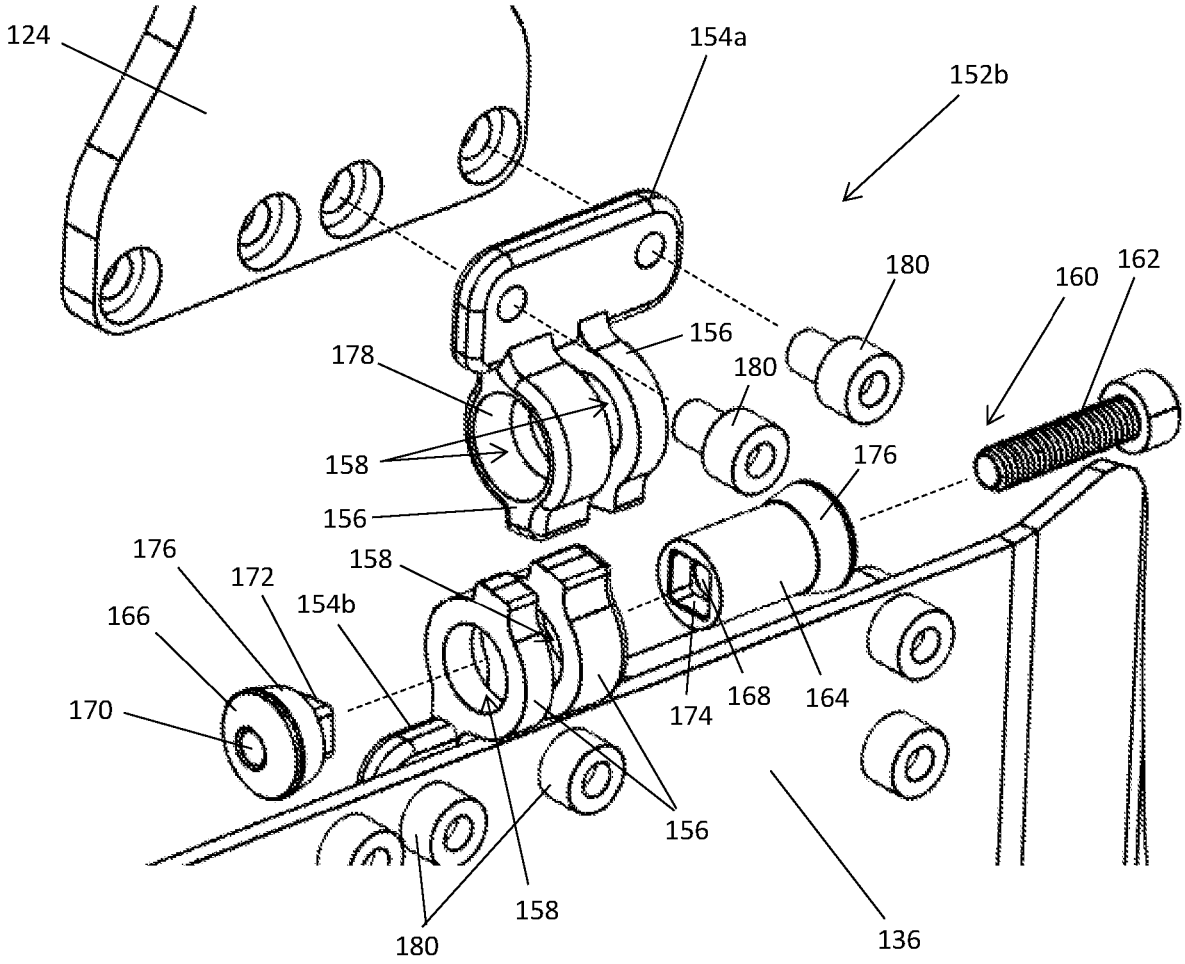
FIG. 6 is a partially exploded enhanced view of a hinge member associated with the first adjustable back support assembly of the adjustable back support shown in FIG. 5, taken along line 6-6 of FIG. 5.

With reference to FIG. 6, the second hinge member 152*b* is shown in an exploded view. While the second hinge member 152*b* is shown, it should be appreciated that the first hinge member 152*a* and the hinge member 152 are substantially the same as the second hinge member 152*b*. In the illustrated embodiment, the second hinge member 152*b* is a mirror image of the first hinge member 152*a*, while the hinge member 152 is rotated 90 degrees relative to the orientation of the second hinge member 152*b*. Each hinge member 152, 152*a*, 152*b* includes a first hinge portion 154*a* and a second hinge portion 154*b*. The hinge portions 154*a*, 154*b* are substantially the same. The first hinge portion 154*a* is rotated 180 degrees relative to the second hinge portion 154*b*. Each hinge portion 154*a*, 154*b* includes at least one finger member 156, and more specifically a plurality of finger members 156. The finger members 156 of each hinge portion 154*a*, 154*b* define a central aperture 158. The finger members 156 of each hinge portion 154*a*, 154*b* are spaced apart on the same hinge portions 154*a*, 154*b*. Stated another way, the finger members 156 of the first hinge portion 154*a* are spaced apart along the first hinge portion 154*a*, and the finger members 156 of the second hinge portion 154*b* are spaced apart along the second hinge portion 154*b*. This spaced apart geometry provides for a meshing relationship of the finger members 156 of the first and second hinge portions 154*a*, 154*b*. Stated another way, the finger members 156 of each hinge portion 154*a*, 154*b* are configured to alternate, aligning the central apertures 158. The aligned central apertures 158 are configured to receive a fastener assembly 160. The fastener assembly 160 includes a fastener 162, a first hub 164, and a second hub 166. The first hub 164 is received by the aligned central apertures 158 of the fingers 156 of the first and second hinge portions 154*a*, 154*b*. The first hub 164 defines a central aperture 168 that is configured to receive the fastener 162. The fastener 162 is a threaded fastener (e.g. a bolt, a screw, etc.) and is configured to engage a complimentary threaded aperture 170. The threaded aperture 170 is defined by the second hub 166. The second hub 166 also includes a geometric projection 172 that is configured to be received by a complimentary geometric recess 174 defined by the first hub 164. The first hub 164 and the second hub 166 each also include a tapered, frustoconical surface 176. The tapered surface 176 is configured to engage a corresponding tapered surface 178 defined by the inner circumference of the central apertures 158 of the two end finger members 156 of the meshed finger members 156. An example of the hinge member 152, 152*a*, 152*b* is also disclosed in U.S. Pat. No. 10,716,721, the contents of which is hereby incorporated by reference in its entirety. In other embodiments, the hinge members 152, 152*a*, 152*b* can be any suitable hinge member assembly that provides a pivot, rotation, or associated movement of one (or both) of the connected members, and further is configured to selectively maintain a desired position in response to the pivot, rotation, or associated movement of one (or both) of the connected members. Each hinge portion 154*a*, 154*b* is fastened to an associated component (e.g., first support member 124 to support shell 136, first support member 124 to second support member 128, and first support member 124 to third support member 132) by at least one fastener 180, and more specifically a plurality of fasteners 180.

Figure 7:
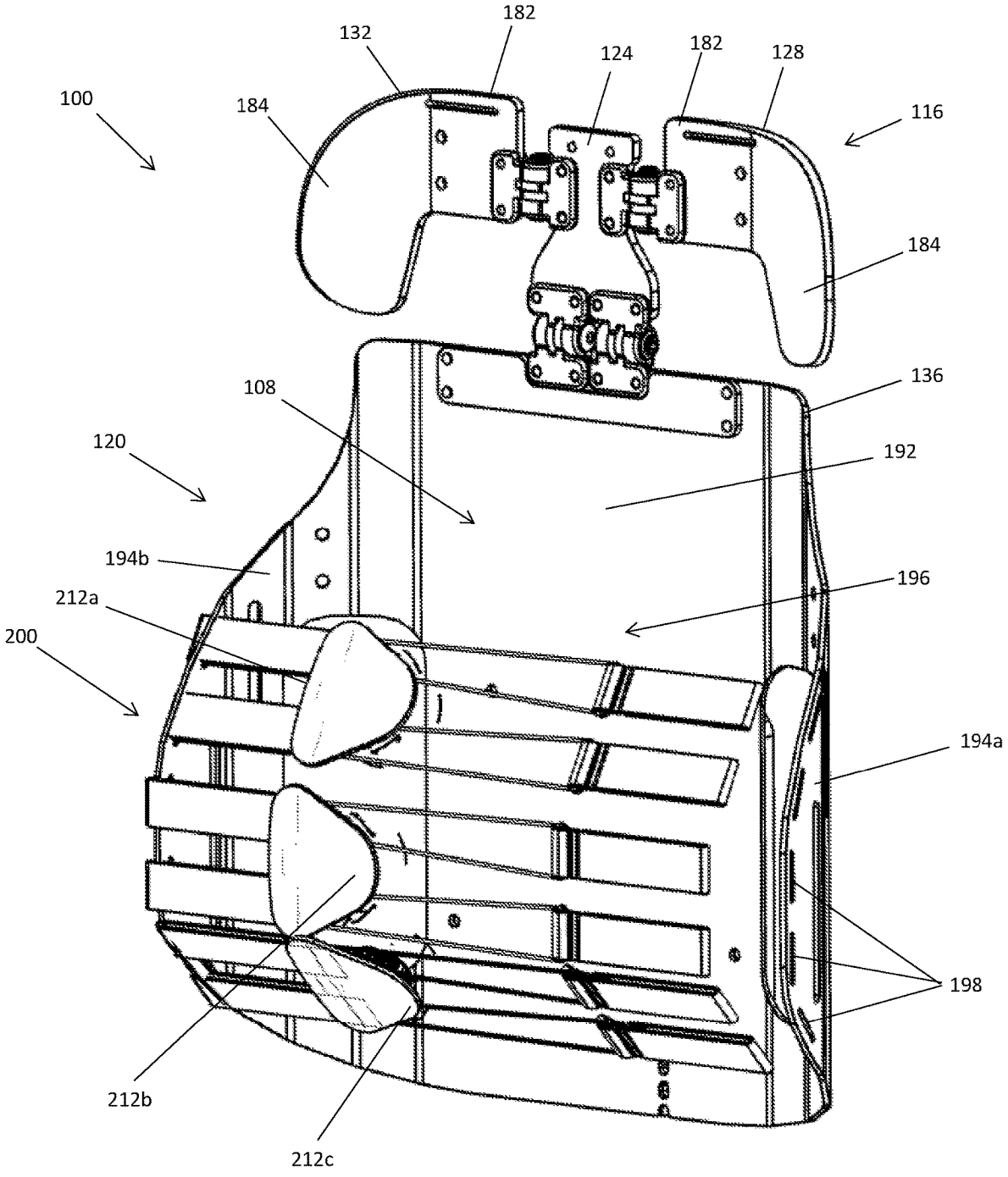
FIG. 7 is a front, user facing perspective view of the adjustable back support shown in FIG. 5, with the adjustable tension assembly detached from a first side support portion to illustrate a plurality of attachment slots.

With reference to FIGS. 5 and 7, the second support member 128 defines a first portion 182 and a second portion 184. The first portion 182 is coupled to the first support member 124 by the second hinge assembly 144. The second portion 184 is arranged at an angle to the first portion 182. More specifically, the second portion 184 is arranged at an oblique angle to the first portion 182, and extends from the first portion 182 towards the user 14. The third support member 132 is substantially the same as the second support member 128. However, the third support member 132 is a mirror image of the second support member 128. In addition, the third support member 132 is coupled to the first support member 124 by the third hinge assembly 144.

Figure 8:
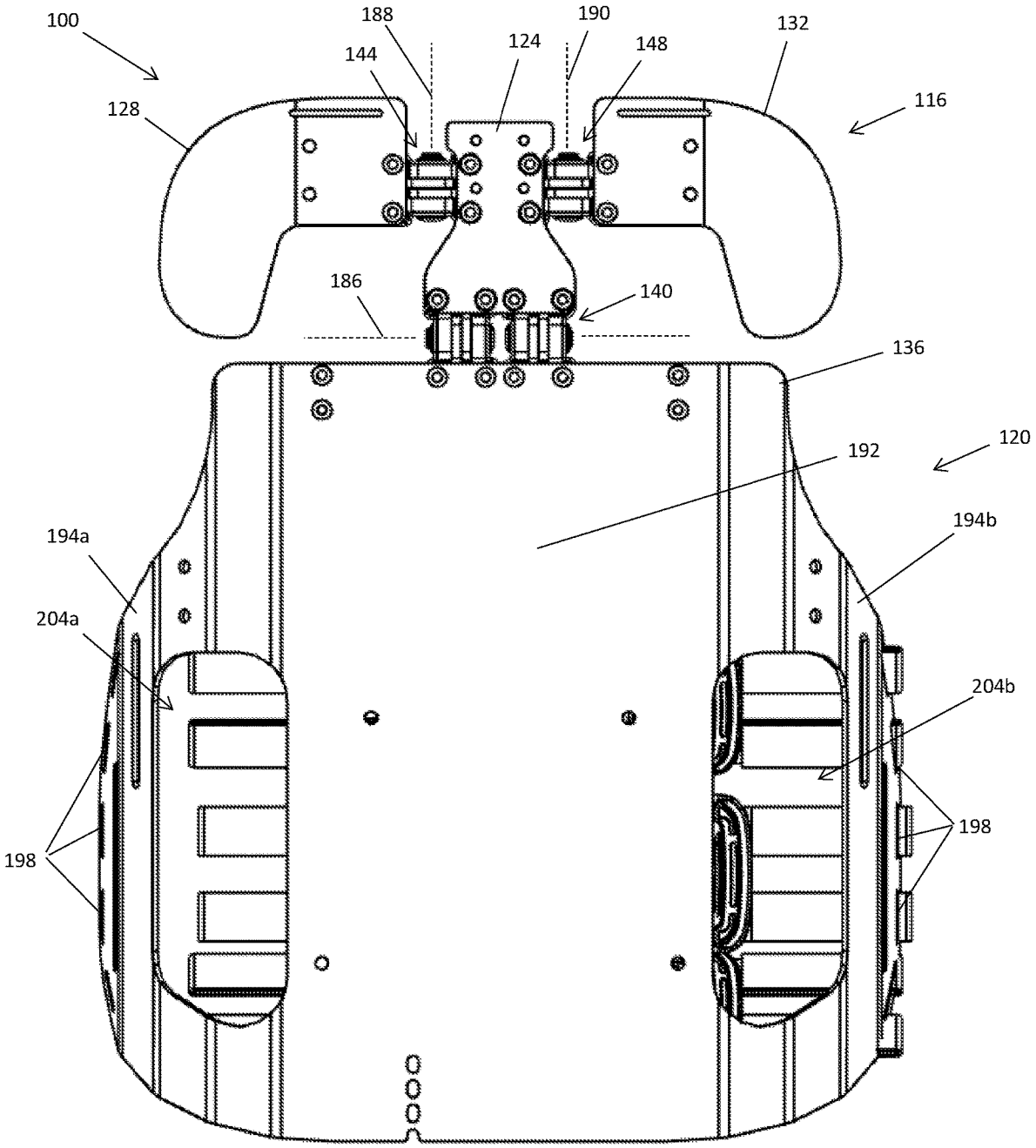
FIG. 8 is a rear plan view of the adjustable back support shown in FIG. 5.

With reference to FIG. 8, the first hinge assembly 140 defines a first axis of rotation 186. More specifically, the at least one hinge portion 154*a*, 154*b* (shown in FIG. 5) defines the first axis of rotation 186. The second hinge assembly 144 defines a second axis of rotation 188. More specifically, the hinge portion 154 (shown in FIG. 5) defines the second axis of rotation 188. The third hinge assembly 144 defines a third axis of rotation 190. More specifically, the hinge portion 154 (shown in FIG. 5) defines the third axis of rotation 190. In the illustrated embodiment, the first axis of rotation 186 is oriented perpendicular to the second and third axes of rotation 188, 190. In addition, the second and third axes of rotation 188, 190 are oriented parallel to each other. In other embodiments, the first axis of rotation 186 can be oriented at an oblique angle to the second and third axes of rotation 188, 190. In addition, the second and third axes of rotation 188, 190 can be oriented at an oblique angle to each other.

The first adjustable back support assembly 116 is configured to be adjustable relative to the user 14 in a plurality of directions. More specifically, the first adjustable back support assembly 116 can be adjusted in three or more degrees of freedom relative to the user 14. The first support member 124 is configured to rotate (or pivot) relative to the second adjustable back support assembly 120, and more specifically the support shell 136, around the first axis of rotation 186. As such, the first support member 124 can rotate (or pivot) towards the user 14 or away from the user 14 relative to the support shell 136. The second and third support members 128, 132 are carried by the first support member 124 as it rotates (or pivots) around the first axis of rotation 186. The second support member 128 is configured to rotate (or pivot) relative to the first support member 124 around the second axis of rotation 188. As such, the second support member 128 can rotate (or pivot) towards the user 14 or away from the user 14 relative to the first support member 124. The third support member 132 is configured to rotate (or pivot) relative to the first support member 124 around the third axis of rotation 190. As such, the third support member 132 can rotate (or pivot) towards the user 14 or away from the user 14 relative to the first support member 124.

With reference back to FIGS. 5, 7, and 8, the second adjustable back support assembly 120 includes the support shell 136. The support shell 136 defines a central shell portion 192 and opposing side support shell portions 194*a, b* (also referred to as side support portions 194*a, b*). The side support shell portions 194*a*, 194*b* each extend away from the central shell portion 192 towards the user 14 at an oblique angle to the central shell portion 192. The central shell portion 192 and opposing side support shell portions 194*a, b* together define a channel 196 (shown in FIG. 7). The channel 196 is configured to receive a portion of the user 14, such as the back of the user 14, in response to engagement with the second adjustable back support assembly 120. Each side support shell portion 194*a, b* defines a plurality of attachment locations 198. The attachment locations 198 provide an attachment point for an adjustable lower back support assembly 200 (also referred to as an adjustable tension assembly 200) (shown in FIG. 7). In the illustrated embodiment, the attachment locations 198 are illustrated as slots 198 (also referred to as attachment slots 198). However, in other embodiments, each attachment location 198 can be any shape or structure suitable to facilitate attachment of the adjustable tension assembly 200 (e.g., an aperture, a hole, a groove, etc.). In the illustrated embodiment, each side support shell portion 194*a, b* includes five attachment locations 198. In other embodiments, each side support shell portion 194*a, b* can include at least one attachment location 198, and more specifically two or more attachment locations 198. Generally, the number of attachment locations 198 are the same on each side support shell portion 194*a, b* to facilitate attachment of the adjustable tension assembly 200. It should be appreciated that the side support shell portions 194*a, b* are substantially the same, but are mirror images of each other.

With reference to FIG. 8, the illustrated embodiment of the support shell 136 defines at least one aperture 204. More specifically, the support shell 136 defines a pair of apertures 204*a, b*. A first aperture 204*a* is positioned between the central shell portion 192 and a first side support shell portion 194*a*. A second aperture 204*b* is positioned between the central shell portion 192 and a second side support shell portion 194*b*. Stated another way, the apertures 204*a, b* are positioned on opposing sides of the central shell portion 192. The apertures 204*a, b* provide access to the channel 196 to facilitate adjustment of the adjustable tension assembly 200. As such, the apertures 204*a, b* can also be referred to as access apertures 204*a, b*. It should be appreciated that the at least one access aperture 204 is optional, and in other embodiments the support shell 136 does not necessarily have at least one access aperture 204.

Figure 9:
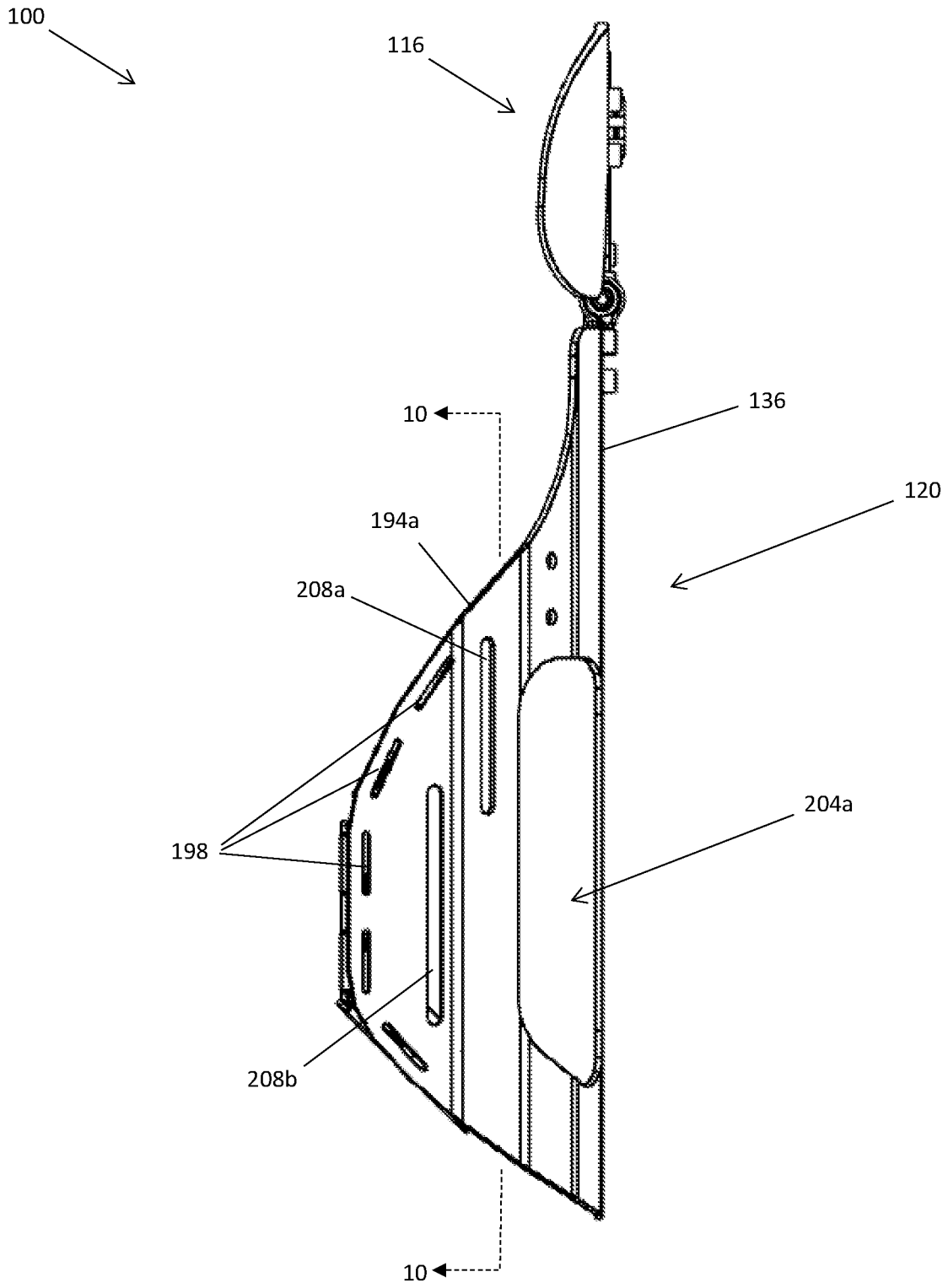
FIG. 9 is a first side view of the adjustable back support shown in FIG. 5.

FIG. 9 illustrates a first side view of the adjustable back support 100. The first side support shell portion 194*a* defines at least one mounting location 208. In the illustrated embodiment, the first side support shell portion 194*a* defines a plurality of mounting locations 208*a, b*. In the illustrated embodiment, each mounting location 208*a, b* is illustrated as an elongated mounting slot 208*a, b*. The elongated mounting locations 208*a, b* facilitate the option for selective attachment of associated components of the wheelchair 10. For example, if desired, a lateral trunk support or any other suitable or desired component that can assist with improving the physical support, health, or experience of the user 14 during use of the wheelchair 10 can be mounted using at least one of the mounting locations 208*a, b*. It should be appreciated that in other embodiments, each mounting location 208 can be any shape or structure suitable to facilitate attachment of an associated component of the wheelchair 10 (e.g., an aperture, a hole, a groove, etc.). While FIG. 9 illustrates the first side support shell portion 194*a*, the second side support shell portion 194*b* is generally a mirror image of the first side support shell portion 194*a*. Accordingly, the second side support shell portion 194*b* includes the same components, including the mounting locations 208*a, b*.

Referring back to FIG. 7, the adjustable tension assembly 200 includes a plurality of tension adjustment members 212. In the illustrated embodiment, the adjustable tension assembly 200 includes a first tension adjustment member 212*a*, a second tension adjustment member 212*b*, and a third tension adjustment member 212*c*. Each tension adjustment member 212*a, b, c* extends between the first side support shell portion 194*a* and the second side support shell portion 194*b*. More specifically, each tension adjustment member 212*a, b, c* is configured to engage at least one attachment location 198 of the first side support shell portion 194*a* and at least one attachment location 198 of the second side support shell portion 194*b*. Each tension adjustment member 212*a, b, c* is accordingly coupled to each of the side support shell portions 194*a*, 194*b*, and further extends from the first side support shell portion 194*a* to the second side support shell portion 194*b* (or from the second side support shell portion 194*b* to the first side support shell portion 194*a*). While the illustrated embodiment of the second adjustable back support assembly 120 depicts three tension adjustment members 212*a, b, c*, in other embodiments, the second adjustable back support assembly 120 can include at least one tension adjustment member 212, a plurality of tension adjustment members 212, or any suitable or desired number of tension adjustment members 212 (e.g., one, two, three, four or more, etc.). It should be appreciated that in the illustrated figures, each tension adjustment member 212*a, b, c* is shown detached from the first side support shell portion 194*a* for purposes of clarity.

Figure 10:
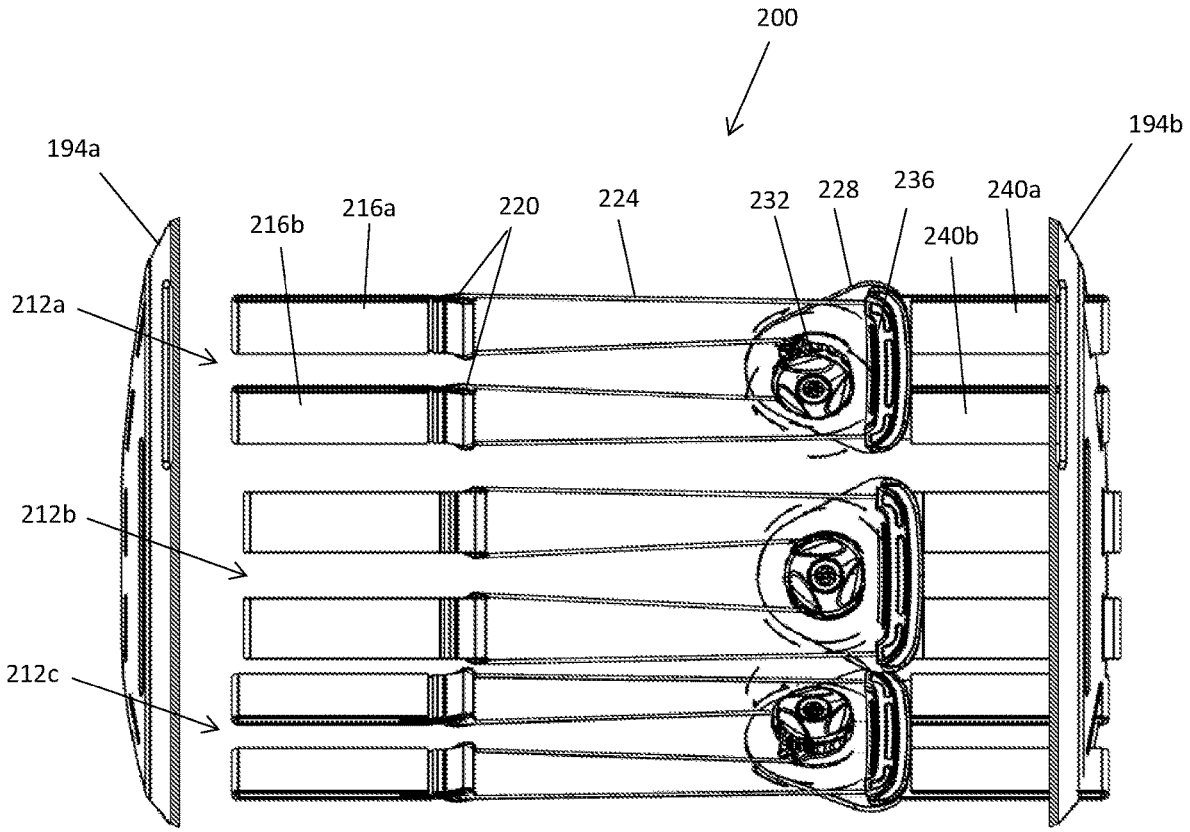
FIG. 10 is a perspective view of the adjustable tension assembly and a portion of the adjustable back support shown in FIG. 5, taken along line 10-10 of FIG. 9.

With reference now to FIG. 10, each tension adjustment member 212*a, b, c* is substantially the same. As such, the tension adjustment members 212*a, b, c* have common components, which will be discussed using common reference numbers. While FIG. 10 provides reference numbers in association with the tension adjustment member 212*a*, the same components are included in tension adjustment members 212*b, c*. The reference numbers are not shown in FIG. 10 in association with tension adjustment numbers 212*b, c* for purposes of clarity. Each tension adjustment member 212*a, b, c* includes a first strap portion 216. The first strap portion 216 is coupled to the support shell 136 (see FIG. 7), and more specifically to the first side support portion 194*a*. The first strap portion 216 is illustrated as two separate straps 216*a*, 216*b* (or strap portions 216*a*, 216*b*). However, in other embodiments the first strap portion 216 can include a single strap or three or more straps. Each first second strap portion 216*a*, 216*b* can include (or define) a first guide member 220 (also referred to as a first guide channel 220). Each first guide member 220 can define (or otherwise provide) a path for a cable 224.

Each tension adjustment member 212*a, b, c* also includes a carrier 228. The carrier 228 carries an adjustable tension member 232. The adjustable tension member 232 is configured to adjust a tension of the cable 224. The adjustable tension member 232 can be a ratchet assembly, a ratchet actuator, or any other suitable assembly for adjusting a tension of the cable 224. The carrier 228 can also carry a second guide member 236 (also referred to as a second guide channel 236). The second guide member 236 provides a path for the cable 224 with respect to the carrier 228. The carrier 228 is also coupled to a second strap portion 240. The second strap portion 240 is coupled to the support shell 136 (see FIG. 7), and more specifically to the second side support portion 194*b*. The second strap portion 240 is illustrated as two separate straps 240*a*, 240*b* (or strap portions 240*a*, 240*b*). However, in other embodiments the second strap portion 240 can include a single strap or three or more straps.

The strap portions 216, 240 are each configured to removably couple to the respective side support portion 194*a*, 194*b*. More specifically, each strap portion 216, 240 can include a self-attachment fastener, such as a hook-and-loop fastener, to facilitate a self-attachment. For example, each strap portion 216, 240 can be received by a corresponding attachment location 198, and then self-attach by engagement of the self-attachment fastener (i.e., a first portion of each strap 216, 240 engages a second portion of the same strap 216, 240). Each strap portion 216, 240 is not limited to use of a self-attachment fastener to facilitate self-attachment. In other embodiments, the strap portions 216, 240 can engage a corresponding attachment location 198, or the respective side support portion 194*a*, 194*b*, with any suitable or desired fastener or attachment system (e.g., a snap, a button and an eyelet, a buckle, a hook-and-eye, lacing, a zip tie, a clamp, a stitched loop, etc.).

The cable 224 is configured to extend from the adjustable tension member 232 to the first guide members 220 defined by the first strap portions 216*a, b*. The cable 224 then extends through the first guide members 220 to the second guide member 236. The path provided by the first and second guide members 220, 236 can reduce friction as a length of the cable 224 is selectively increased or decreased, while also guiding the cable 224 between the side support portions 194*a*, 194*b*, and more specifically between the strap portions 216, 240.

The adjustable tension member 232 is configured to be operated in a first configuration to decrease the length of the cable 224 extending between the side support portions 194*a*, 194*b*, and more specifically to decrease the length of the cable 224 extending between the strap portions 216, 240. In addition, the adjustable tension member 232 is configured to be operated in a second configuration to increase the length of the cable 224 extending between the side support portions 194*a*, 194*b*, and more specifically to increase the length of the cable 224 extending between the strap portions 216, 240. For example, in the illustrated embodiment, in the first configuration the adjustable tension member 232 can be rotated relative to the carrier 228 to decrease the length of the cable 224 extending between the side support portions 194*a*, 194*b* (or the strap portions 216, 240). In the second configuration, the adjustable tension member 232 can be actuated by sliding a portion of the member 232 perpendicular to the carrier 228 along an axis of rotation of the member 232. This facilitates an increase in the length of the cable 224 extending between the side support portions 194*a*, 194*b* (or the strap portions 216, 240). It should be appreciated that to facilitate operation in the first or second configurations, the adjustable tension member 232 can be accessed through one (or both) of the access apertures 204*a, b* when the adjustable back support 100 is mounted to the wheelchair 10. The access apertures 204*a, b* facilitate access to each adjustable tension member 232 through the channel 196. It should also be appreciated that one or more alternative examples of the tension adjustment member 212*a, b, c* is also disclosed in U.S. Pat. Nos. 9,789,019 and 9,986,840, the contents of each patent is hereby incorporated by reference in its entirety.

In other embodiments, the adjustable lower back support assembly 200 can include alternative structural components to achieve certain functionality for supporting a portion of the user 14, as discussed further below. For example, in certain embodiments, each tension adjustment member 212*a, b, c* can include at least one strap (or elongated material) and a tension adjustment actuator. The tension adjustment actuator can be any device suitable to adjust a length of exposed strap material (e.g., a ratchet buckle configured to adjust a strap, ladder strap, or belt, a buckle configured to adjust a cinch cam strap, a cam buckle configured to adjust a strap, etc.). In yet other embodiments, each tension adjustment member 212*a, b, c* can be defined by a support member, such as a foam block, a foam wedge, or any other structure suitable for supporting a portion of the user 14, as discussed further below.

In operation, the adjustable back support 100 provides two different back support assemblies, the first adjustable back support assembly 116 and the second adjustable back support assembly 120, to provide adjustable, targeted support for a plurality of portions 22, 26 of the back (or spine) of the user 14.

The first adjustable back support assembly 116 can be adjusted to selectively engage the first portion 22 of the user 14 to provide improved support to a user 14. It should be appreciated that the first adjustable back support assembly 116 is configured to engage the first portion 22 of the user 14 independent of the spinal shape of the user 14. More specifically, the user 14 can have any spinal shape, may or may not have a spinal deformity, and further may or may not have a spinal deformity in the sagittal and/or coronal planes. However, for a user 14 having one or more deformities (or a plurality of deformities) in the sagittal and/or coronal planes, the first adjustable back support assembly 116 can accommodate, correct, or improve spinal postures seen in the sagittal and/or coronal planes. The first adjustable back support assembly 116 can be adjusted to selectively engage the first portion 22 of the user 14 through adjustment (or movement) of the first adjustable back support assembly 116 relative to the second adjustable back support assembly 120. More specifically, the first support member 124 can pivot (or rotate) towards the user 14 or away from the user 14 relative to the support shell 136. The second and third support members 128, 132 are carried by the first support member 124 as it pivots (or rotates) around the first axis of rotation 186 defined by the first hinge assembly 140. The second support member 128 can pivot (or rotate) towards the user 14 or away from the user 14 relative to the first support member 124. The second support member 128 pivots (or rotates) around the second axis of rotation 188 defined by the second hinge assembly 144. The third support member 132 can pivot (or rotate) towards the user 14 or away from the user 14 relative to the first support member 124. The third support member 132 pivots (or rotates) around the third axis of rotation 190 defined by the third hinge assembly 148. This adjustment provides support customized to the user 14, and more specifically to address specific support needs required by the user 14 when using the wheelchair 10. It should be appreciated that to facilitate movement of the support members 124, 128, 132, the associated hinge assembly 140, 144, 148 is loosened to allow the described pivoting (or rotational) movement. Once a desired position of each support member 124, 128, 132 is achieved, the associated hinge assembly 140, 144, 148 is tightened to restrict further movement (such as undesirable or unintentional movement that could adversely address the selected support provided by the first adjustable back support assembly 116).

The second adjustable back support assembly 120 can be adjusted to selectively engage the second portion 26 of the user 14 to provide improved support to the user 14 in the sacral lumbar region and/or the posterior superior iliac spine ("PSIS") region. More specifically, the second adjustable back support assembly 120 is configured to be actuated in a plurality of configurations to accommodate, correct, or improve spinal postures seen in the sacral lumbar region and/or the posterior superior iliac spine region. The second adjustable back support assembly 120 can improve alignment and redistribute pressure throughout the sacral lumbar region and/or PSIS region, which reduces strain (and pain) on the user 14. It should be appreciated that the second adjustable back support assembly 120 is configured to engage the second portion 26 of the user 14 independent of the spinal shape of the user 14. More specifically, the user 14 can have any spinal shape, may or may not have a spinal deformity, and further may or may not have a spinal deformity in the sacral lumbar region and/or the PSIS region. Independent of the user 14, the second adjustable back support assembly 120 can operate with the first adjustable back support assembly 116 to improve or accommodate a sitting posture of the user 14. In the illustrated embodiment, each tension adjustment member 212, 212*a*, 212*b*, 212*c* can be actuated to establish a desired length of the cable 224. Each adjustable tension member 232 associated with each tension adjustment member 212, 212*a*, 212*b*, 212*c* can be selectively operated in the first configuration to decrease the length of exposed cable 224 or in the second configuration to selectively increase the length of exposed cable 224. The desired exposed length of the cable 224 (e.g., either a longer or a shorter exposed length of the cable 224) can be selected based on a comfort of the user 14, a proper pelvic neutral position sitting position of the user 14, and/or as an orthotic to achieve a desired outcome for the user 14. Each tension adjustment member 212, 212*a*, 212*b*, 212*c* provides selective support for the user 14, while the user 14 has room to extend into the channel 196.

Figure 11:
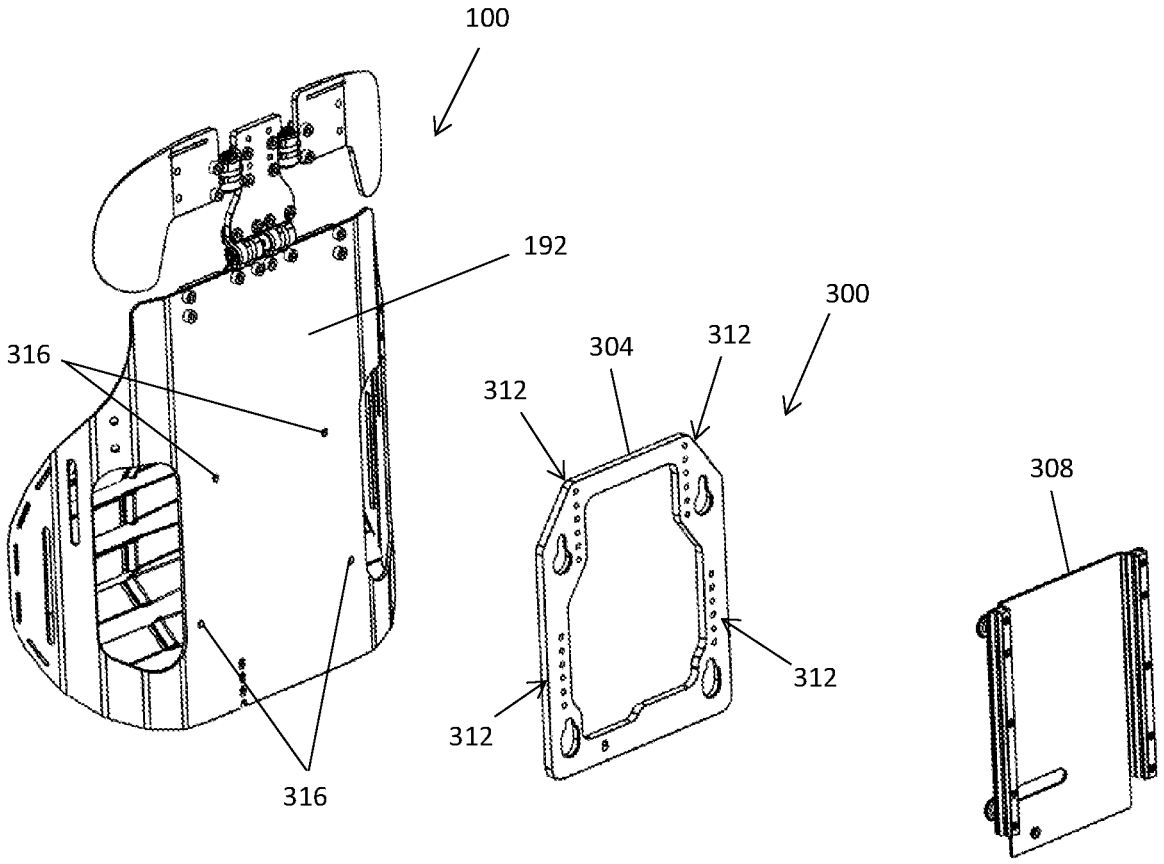
FIG. 11 is a rear perspective view of the adjustable back support shown in FIG. 3, with the mounting assembly shown detached from the adjustable back support.

There are a plurality (or numerous) alternatives available to mount the adjustable back support 100 to an associated sitting platform. The alternative used often is dependent upon the associated sitting platform. In the illustrated embodiment shown in FIGS. 11-12, the mounting assembly 300 shown is for mounting the adjustable back support 100 to the wheelchair 10, and more specifically the power wheelchair 10. An example of the mounting assembly 300 is shown in U.S. Pat. No. 10,369,065, which is herein incorporated by reference in its entirety. The mounting assembly 300 includes an adapter plate 304 that is configured to selectively attach to a slide plate 308. With reference to FIG. 11, the adapter plate 304 includes a plurality of first apertures 312. The plurality of first apertures 312 are positioned in four different vertically aligned groups of first apertures 312. One aperture from each of the groups of apertures 312 is configured to align with an associated aperture 316 in the central shell portion 192. Each of the aligned apertures 312, 316 are configured to receive a fastener (not shown) (e.g., a bolt, screw, etc.) to selectively attach the adapter plate 304 to the adjustable back support 100. The four different vertically aligned groups of first apertures 312 of the adapter plate 304 provides adjustability of the adapter plate 304 relative to the adjustable back support 100. For example, different user's 14 may have different heights, shapes, sizes, or ages (e.g., juvenile vs. adult). This may require a different position of the adapter plate 304 relative to the adjustable back support 100 to facilitate a proper fit of the adjustable back support 100 to the user.

Figure 12:
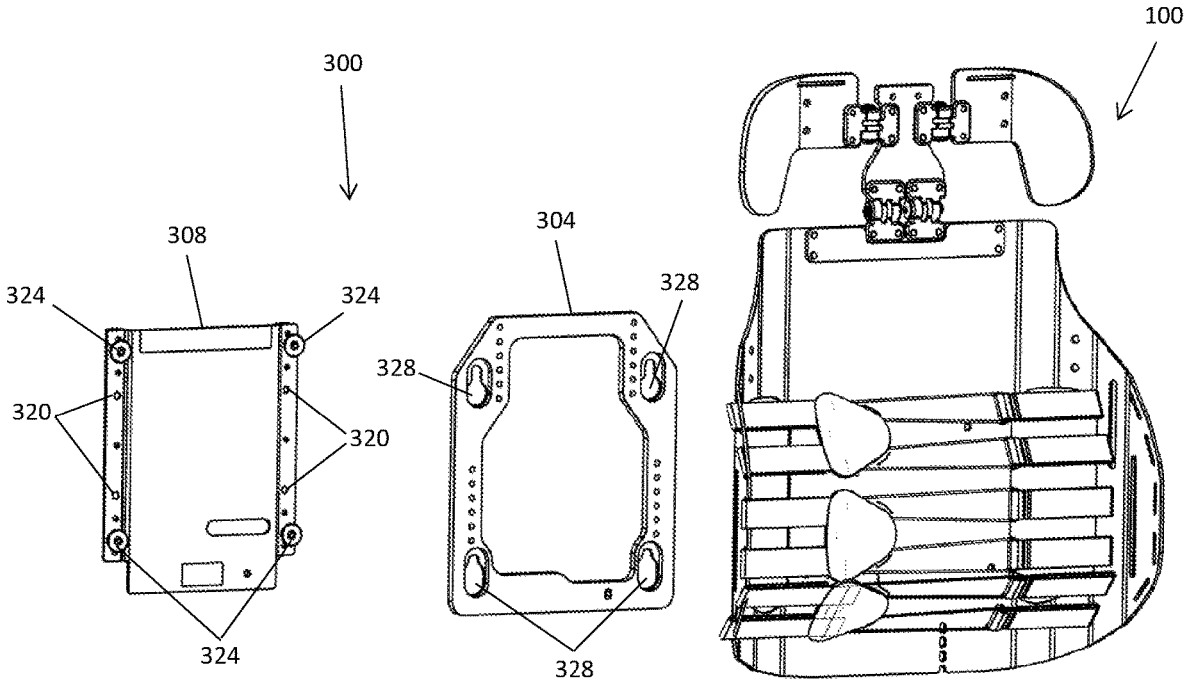
FIG. 12 is a front perspective view of the adjustable back support shown in FIG. 11.

With reference to FIG. 12, an example of the slide plate 308 is illustrated. It should be appreciated that the slide plate 308 can have a different shape, configuration, or structure dependent upon the manufacturer of the wheelchair 10, and further the manufacturer of the power wheelchair 10. The slide plate 308 shown in FIG. 12 is associated with the M3 CORPUS power wheelchair sold by Permobil AB. In various alternative embodiments, the slide plate 308 can be any suitable structure or component to couple the adjustable back support 100 to the wheelchair 10. Further, in yet other embodiments, the slide plate 308 can be optional, and any structure suitable for selectively attaching the adjustable back support 100 to a sitting platform 10 can be used. With specific reference to FIG. 12, the adapter plate 304 is configured to selectively attach to the slide plate 308. The slide plate 308 is configured to selectively attach to the wheelchair 10. The slide plate 308 can include a plurality of apertures 320. The apertures 320 are configured to align with corresponding apertures (not shown) on the wheelchair 10. These aligned apertures 320, not shown are configured to receive a fastener (not shown) (e.g., a bolt, screw, etc.) to selectively attach the slide plate 308 to the wheelchair 10. The slide plate 308 also includes a plurality of pins 324. Each of the pins 324 is configured to be selectively received by an associated pin aperture 328 defined by the adapter plate 304. Each pin aperture 328 receives one of the pins 324 to removably fasten the slide plate 308 to the adapter plate 304 (and the adjustable back support 100 to the wheelchair 10).

Figure 13:
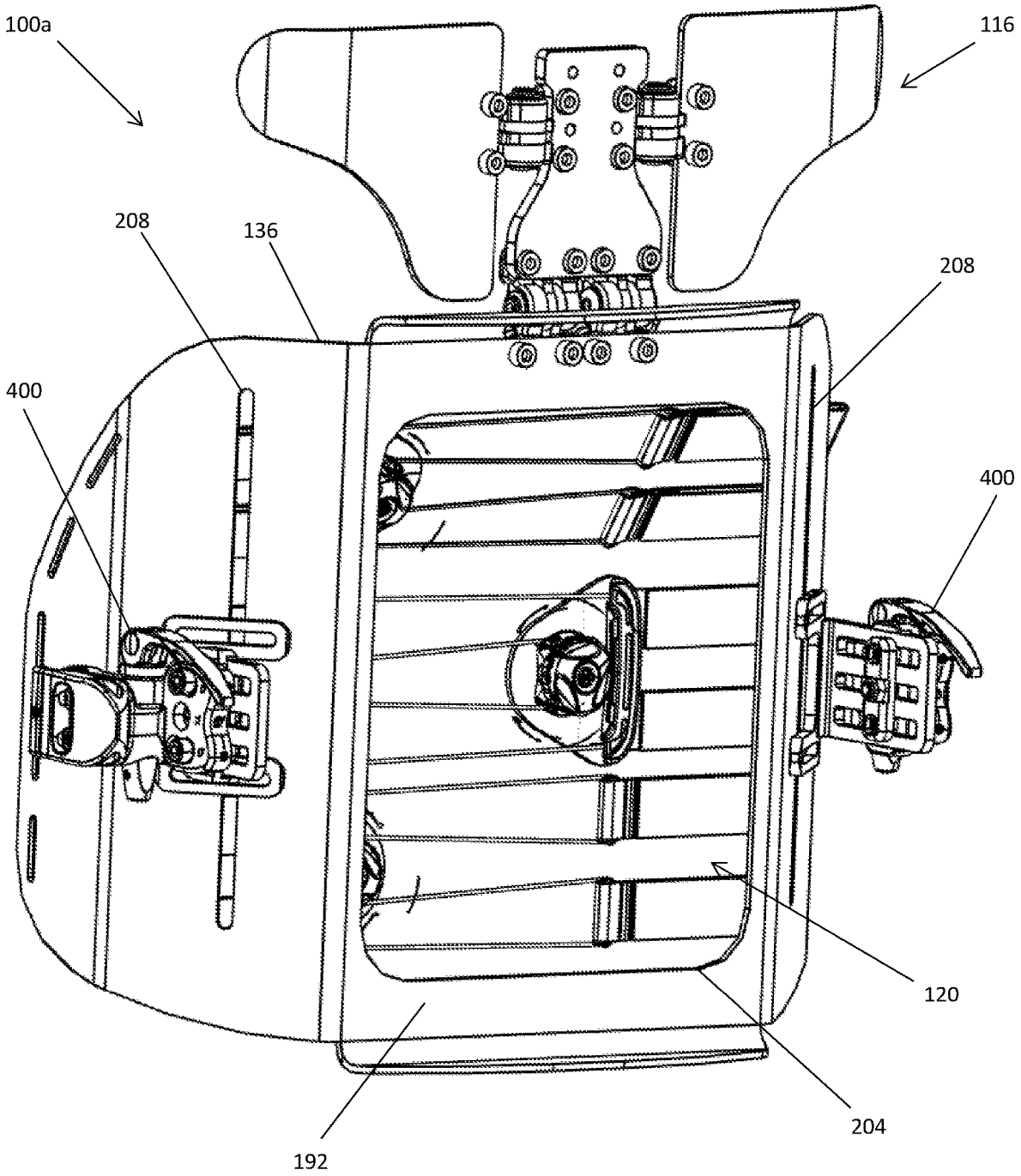
FIG. 13 is a rear perspective view of another example of an embodiment of an adjustable back support.

FIG. 13 illustrated another example of an embodiment of an adjustable back support 100*a*. The adjustable back support 100*a* includes the same features as the adjustable back support 100, with like numbers identifying like components. For brevity and clarity, the differences are highlighted below. Although not limited thereto, the adjustable back support 100*a* can be configured for attachment to a manual wheelchair 10, or other sitting platform or mobility device having cane mounts. As such, the adjustable back support 100*a* includes cane clamp assemblies 400 selectively mounted to the elongated mounting slots 208 defined by the support shell 136. An example of the cane clamp assembly 400 is disclosed in U.S. Pat. No. 10,595,635, the contents of which is hereby incorporated by reference in its entirety. In the illustrated example, the adjustable back support 100*a* also includes a single access aperture 204 that is defined by the central shell portion 192. As an example, a manual wheelchair generally does not include a structural back that requires mounting with the mounting assembly 300. Stated another way, there is no structure blocking access to the aperture 204 in the central shell portion 192. This structure can require multiple access apertures 204*a*, 204*b* to provide access to the second adjustable back support assembly 120.

Figure 14:
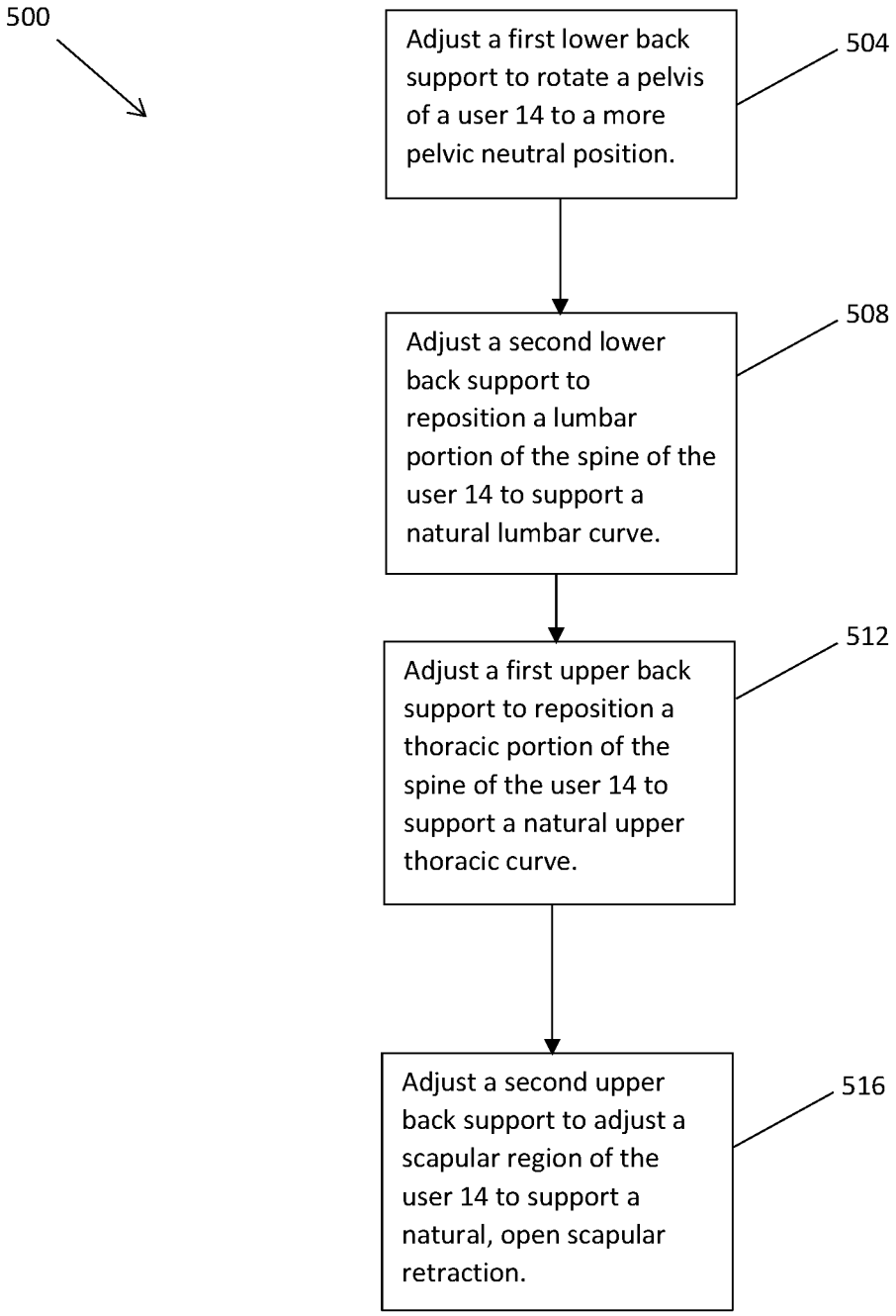
FIG. 14 is a flow diagram of an embodiment of a system for selectively adjusting the posture of a user sitting in the wheelchair.

With reference now to FIG. 14, there will now be described a procedure 500 (or a process 500) for selectively adjusting one or more flexible deformities seen in the sagittal plane of the user 14 when positioned in the wheelchair 10. It should be appreciated that the procedure 500 is also configured to adapt to one or more fixed deformities of the user 14, such as deformities seen in the sagittal plane. A fixed deformity in the sagittal plane can include, but is not limited to scoliosis, kyphosis, lordosis, flatback syndrome, any sagittal imbalance, or any other a congenital, idiopathic, degenerative, or post-traumatic deformity of the spine or portion of the body. If a user 14 has a fixed deformity that cannot be adjusted, repositioned, or otherwise moved in response to adjustment of one or more of the described lower and/or upper back supports, the procedure 500 can be adapted to the user 14 by omitting one or more of the related steps of the procedure 500. Omission of one or more of the steps facilitates accommodation to the user 14, while also resulting in improved support for the user 14 of the wheelchair 10. As such, the procedure 500 is advantageously adapted to accommodate different needs of different users 14, while still providing improved support for the user 14.

It should be appreciated that the procedure 500 illustrated in FIG. 14 is described in association with the adjustable back support 100, 100*a*. However, the procedure 500 can be implemented with any suitable back support and/or adjustment assembly to reposition the portion of the user 14 described therein. For purposes of explanation, the procedure 500 is illustrated as including a series of steps that are depicted in flow diagram form in FIG. 14. As noted above, to accommodate different users 14, such as a user having one or more fixed deformities, it should be appreciated that one or more of the steps can be selectively omitted.

Referring to FIG. 14, prior to step 504, the user 14 can be sitting in the wheelchair 10 (or other sitting platform or mobility device). While it can be advantageous to have the user 14 sitting in the wheelchair 10, in other embodiments the user 14 does not have to be sitting or otherwise positioned in the wheelchair 10 (or other sitting platform or mobility device).

The procedure 500 begins at step 504. At step 504, a first lower back support can be adjusted to engage and adjust a first, lower portion of the back of a user 14. The first lower back support is configured to adjust a position of the pelvis of the user 14, rotating the pelvis to a more pelvic neutral position. This can include rotating the pelvis forward or backward. In one example of an embodiment, the first lower back support can include the adjustable lower back support assembly 200. More specifically, the first lower back support can include at least one tension adjustment member 212 (see FIG. 10). In certain embodiments, the at least one tension adjustment member 212 can include the third tension adjustment member 212*c*. In other embodiments, the at least one tension adjustment member 212 can include the third tension adjustment member 212*c* and the second tension adjustment member 212*b*. Generally, the first lower back support can include the portion of the adjustable lower back support assembly 200 that engages the user 14 at a position to facilitate adjustment of the sacral lumbar region and/or PSIS region. In yet other embodiments, the first lower back support assembly can include a foam block, a foam wedge, or any other structure suitable for repositioning the pelvis of the user 14 to a more pelvic neutral position (e.g., rotation of the pelvis forward, rotation of the pelvis backward, etc.).

Next, at step 508, a second lower back support can be adjusted to engage and adjust a second portion of the back of the user 14. The second portion of the back of the user 14 is generally positioned above the first portion of the back of the user 14 (or towards the head). The second lower back support is configured to adjust a curvature (or position) of the lumbar portion of the spine, to support a natural lumbar curve. It should be appreciated that the lumbar portion of the spine is positioned above the pelvic region (or towards the head of the user 14). The second lower back support is positioned above the first lower back support (or laterally closer to the first adjustable back support assembly 116 than the first lower back support). The second lower back support can include at least one tension adjustment member 212 (see FIG. 10). In certain embodiments, the at least one tension adjustment member 212 can include the first tension adjustment member 212*a*. In other embodiments, the at least one tension adjustment member 212 can include the first tension adjustment member 212*a* and the second tension adjustment member 212*b*. Generally, the second lower back support can include the portion of the adjustable lower back support assembly 200 that engages the user 14 at a position to facilitate adjustment of the sacral lumbar region and/or lumbar portion of the spine. In yet other embodiments, the second lower back support can include a foam block, a foam wedge, or any other structure suitable for repositioning and/or supporting the lumbar portion of the spine of the user 14 to provide a natural lumbar curve. It should be appreciated that in the illustrated embodiments, the first lower back support and the second lower back support are defined by the adjustable lower back support assembly 200.

At step 512, a first upper back support can be adjusted to engage and adjust a third portion of the back of the user 14. The third portion of the back of the user 14 is generally positioned above the first portion and the second portion of the back of the user 14 (or closer towards the head). The first upper back support is configured to adjust (or pivot or position) the thoracic region of the spine, to support a natural thoracic curve (or a natural upper thoracic curve). This in turn provides a more complete (or full) thoracic extension. It should be appreciated that the thoracic curve can be defined by the T1-T6 vertebrae of the spine of the user 14. The first upper back support is positioned above the second lower back support and the first lower back support. In certain embodiments, the first upper back support can include the first support member 124 (see FIG. 8). In yet other embodiments, the first upper back support can include a foam block, a foam wedge, or any other structure suitable for repositioning and/or supporting the thoracic portion of the spine of the user 14 to provide a natural upper thoracic curve.

At step 516, a second upper back support can be adjusted to engage and adjust a fourth portion of the back of the user 14. The fourth portion of the back of the user 14 is generally positioned above the first portion and the second portion of the back of the user 14 (or closer towards the head). The second upper back support is configured to adjust (or pivot or position) a scapular region to support a natural, open scapular retraction. In certain embodiments, the second upper back support can include the second and third support members 128, 132 (see FIG. 8). In yet other embodiments, the second upper back support can include a foam block, a foam wedge, or any other structure suitable for repositioning and/or supporting the scapular region of the user 14 to provide for natural, open scapular retraction.

One or more aspects of the adjustable back support 100, 100*a* provides certain advantages. For example, the two different, separately adjustable back support assemblies 116, 120 of the adjustable back support 100, 100*a* advantageously provides customized support for the user 14, while selectively providing improved positioning and support to the user 14 in the sacral lumbar region, the posterior superior iliac spine ("PSIS") region, while also providing support and addressing any deformities in the sagittal and/or coronal planes. In addition, the separately adjustable back support assemblies 116, 120 of the adjustable back support 100, 100*a* provides for improved posture and support of the user 14 by adjusting (or rotating) the pelvis into a more pelvic neutral position, adjusting the lumbar curvature to a more natural lumbar curve, adjusting the thoracic region curvature to a more natural upper thoracic curve, and adjusting a scapular region to provide for a more natural, open scapular retraction. This improves user 14 posture, reduces risk of injury from extended sitting, and overall improves the health of the user 14 while sitting in the wheelchair 10. The separately adjustable back support assemblies 116, 120 can also provide selective support for a user 14 having one or more flexible deformities in the sagittal plane, while also advantageously accommodating a user 14 having one or more fixed deformities in the sagittal plane. These and other advantages are realized by the disclosure provided herein.

What is claimed is:

1. An adjustable back support for a mobility device comprising:

a first adjustable back support assembly including a first support member and a second support member; and a second adjustable back support assembly including a support shell defining a first side support portion spaced from a second side support portion, and at least one adjustable tension assembly extending from the first side support portion to the second side support portion, wherein the first support member is moveably connected to the second adjustable back support assembly, the first support member being configured to pivot relative to the second adjustable back support assembly relative to a first axis of rotation, and wherein the second support member is moveably connected to the first support member, the second support member being configured to pivot relative to the first support member relative to a second axis of rotation that is not parallel to the first axis of rotation.

2. The adjustable back support of claim 1, wherein the first adjustable back support assembly is configured to engage a first portion of a user in the thoracic vertebrae region, and the second adjustable back support assembly is configured to engage a second portion of the user in the sacral lumbar region.

3. The adjustable back support of claim 1, wherein the first adjustable back support assembly is vertically offset from the second adjustable back support assembly.

4. The adjustable back support of claim 1, wherein the first support member is moveably connected to the second adjustable back support assembly by a first hinge assembly.

5. The adjustable back support of claim 4, wherein the second support member is moveably connected to the first support member by a second hinge assembly.

6. The adjustable back support of claim 5, wherein the first hinge assembly defines the first axis of rotation, and the second hinge assembly defines the second axis of rotation.

7. The adjustable back support of claim 6, wherein the first axis of rotation is perpendicular to the second axis of rotation.

8. The adjustable back support of claim 6, wherein the first axis of rotation is oblique to the second axis of rotation.

9. The adjustable back support of claim 5, further comprising a third support member moveably connected to the first support member by a third hinge assembly.

10. The adjustable back support of claim 9, wherein the third hinge assembly defines a third axis of rotation.

11. The adjustable back support of claim 10, wherein the first axis of rotation is perpendicular to the third axis of rotation.

12. The adjustable back support of claim 10, wherein the first axis of rotation is oblique to the third axis of rotation.

13. The adjustable back support of claim 1, wherein the at least one adjustable tension assembly includes a tension adjustment member in communication with a cable, the tension adjustment member configured to adjust a length of the cable.

14. The adjustable back support of claim 1, wherein:

the at least one adjustable tension assembly is configured to selectively engage a pelvis, to support a more pelvic neutral position, and to selectively engage a lumbar portion of a spine, to support a natural lumbar curve, the first support member is configured to selectively engage a thoracic region of the spine, to support a natural thoracic curve, and the second support member is configured to selectively engage a scapular region to support a natural, open scapular retraction.

15. An adjustable back support for a mobility device comprising:

a first adjustable back support assembly including a first support member and a second support member; and a second adjustable back support assembly configured to support a lumbar portion of a spine of a user, wherein the first support member is moveably connected to the second adjustable back support assembly, the first support member being configured to pivot relative to the second adjustable back support assembly relative to a first axis of rotation, the first support member configured to support a thoracic portion of the spine of the user, and wherein the second support member is moveably connected to the first support member, the second support member being configured to pivot relative to the first support member relative to a second axis of rotation different from the first axis of rotation, the second support member configured to support a scapular region of the user.

16. The adjustable back support of claim 15, wherein the first adjustable back support assembly is vertically offset from the second adjustable back support assembly.

17. The adjustable back support of claim 15, wherein the first support member is moveably connected to the second adjustable back support assembly by a first hinge assembly, and the second support member is moveably connected to the first support member by a second hinge assembly.

18. The adjustable back support of claim 17, wherein the first hinge assembly defines the first axis of rotation, and the second hinge assembly defines the second axis of rotation.

19. The adjustable back support of claim 18, wherein the first axis of rotation is perpendicular to the second axis of rotation.

20. The adjustable back support of claim 18, wherein the first axis of rotation is oblique to the second axis of rotation.

21. The adjustable back support of claim 17, further comprising a third support member moveably connected to the first support member by a third hinge assembly, the third hinge assembly defines a third axis of rotation, the third support member configured to support the scapular region of the user.

22. The adjustable back support of claim 21, wherein the first axis of rotation is perpendicular to the third axis of rotation.

23. The adjustable back support of claim 21, wherein the first axis of rotation is oblique to the third axis of rotation.

24. The adjustable back support of claim 15, the second adjustable back support assembly further comprising:

a support shell defining a first side support portion spaced from a second side support portion;

at least one adjustable tension assembly extending from the first side support portion to the second side support portion.

25. The adjustable back support of claim 24, wherein the at least one adjustable tension assembly includes a tension adjustment member in communication with a cable, the tension adjustment member configured to adjust a length of the cable.

26. The adjustable back support of claim 15, the first adjustable back support assembly including a third support member, wherein the third support member is moveably connected to the first support member, the third support member being configured to pivot relative to the first support member relative to a third axis of rotation different from the first axis of rotation, the third support member configured to support the scapular region of the user.

27. The adjustable back support of claim 26, wherein:

the second adjustable back support assembly includes a plurality of tension adjustment members configured to selectively engage a pelvis of the user, to support a more pelvic neutral position, and to selectively engage the lumbar portion of the spine of the user, to support a natural lumbar curve, the first support member configured to support a natural thoracic curve, and the second and third support members configured to support a natural, open scapular retraction.

* * * * *